United States Patent [19]

Zimmer

[11] Patent Number: 4,538,541

[45] Date of Patent: Sep. 3, 1985

[54] METHOD OF AND APPARATUS FOR APPLYING A UNIFORM LAYER OF LIQUID TO A SURFACE

[76] Inventor: Johannes Zimmer, Ebentalerstr. 133, 9020 Klagenfurt, Austria

[21] Appl. No.: 480,113

[22] Filed: Mar. 29, 1983

[30] Foreign Application Priority Data

Mar. 29, 1982 [AT] Austria ..... 1197/82

[51] Int. Cl.[3] ..... B05C 1/08

[52] U.S. Cl. ..... 118/258; 118/211; 118/261; 118/262; 118/264; 118/259; 118/413

[58] Field of Search ..... 118/413, 211, 212, 261, 118/264, 258, 203, 419, 414, 259, 262, 72; 427/428

[56] References Cited

U.S. PATENT DOCUMENTS

| | | | |
|---|---|---|---|
| 1,871,013 | 8/1932 | Shakespeare | 118/261 |
| 2,257,373 | 9/1941 | Fanselow | 118/413 |
| 3,014,454 | 12/1961 | Smejda | 118/413 |
| 3,031,872 | 5/1962 | Kusters | 118/203 |
| 3,128,494 | 4/1964 | Hohmann | 118/261 |
| 3,457,896 | 7/1969 | Herman et al. | 118/249 |
| 3,632,374 | 1/1972 | Greiller | 118/324 |
| 3,762,365 | 10/1973 | Herzog | 118/212 |
| 4,014,289 | 3/1977 | Zimmer | 118/213 |
| 4,167,916 | 9/1979 | Pierce | 118/212 |
| 4,302,486 | 11/1981 | Harbs | 118/262 |
| 4,351,264 | 9/1982 | Flaum et al. | 118/261 X |
| 4,357,896 | 11/1982 | Feldkamper | 118/262 |

*Primary Examiner*—Shrive P. Beck

*Attorney, Agent, or Firm*—Karl F. Ross; Herbert Dubno

[57] ABSTRACT

A liquid film as applied to a transfer drum or planar surface by the textural force of a member in a trough which contacts one wall of the trough to prevent entrainment of air into the body by the member, e.g. a roller, while a wiper or the like engages the surface to prevent entrainment of air by the latter into the trough.

11 Claims, 15 Drawing Figures

PRIOR ART

METHOD OF AND APPARATUS FOR APPLYING A UNIFORM LAYER OF LIQUID TO A SURFACE

FIELD OF THE INVENTION

The present invention relates to a method of and to an apparatus for applying a uniform layer of liquid to a surface and, more particularly, to a method of and to an apparatus for transferring preferably small quantities of liquid to the surface of a drum, to a web of fabric, paper or like material, or to a like relatively wide surface utilizing at least in part a liquid-transfer roller osculating a surface to which the liquid is to be applied.

BACKGROUND OF THE INVENTION

The application of relatively small quantities of liquid to a drum surface or to the surface of a web or other substrate, e.g. a surface on a drum or guided around a drum, is important in a variety of fields.

For example, in printing, the liquid may be a color-carrying medium, e.g. a printing ink or dyestuff, which must be applied to the surface of a fabric web or to some other flexible surface. In printing applications, moreover, it frequently is desirable to apply a liquid, e.g. a masking liquid or an information-carrying liquid, to a drum which can then be used to transfer the liquid, to provide a graphic result or for some other purpose.

In yet other fields, e.g. in the coating of materials, it is desirable to transfer liquid from a bulk supply in more or less film form to a substrate directly or via a drum. In still other fields, the transfer of a thin liquid layer to a web or substrate may be desirable to effect a reaction, bring about a change in a physical state or simply as a temporary measure utilizing the liquid in some process application, or to coat the substrate permanently or temporarily.

It is not uncommon where the liquid must be transferred to a surface, to provide a liquid-containing trough, a liquid-applying roller partially immersed in this trough for entraining the liquid to the surface, and a doctor blade or the like which in part controls the thickness of the layer applied to the surface.

It is known in connection with such transfer rollers, moreover, to utilize grooved or otherwise controlled application rollers, especially where more viscous liquids are to be transferred, i.e. the material to be transferred has more or less a pasty character.

It is also known to smooth out the layer on the surface of such roller with a doctor blade, to remove excess liquid from the surface of the roller with a stripping blade and to operate, in the latter cases, with relatively large quantities of liquid which uncontrollably are in contact with the atmosphere are circulated within the container in which the roller is mounted.

More specifically, mention may be made of the two major problems hitherto encountered when an applying roller was used to transfer liquid to a surface moving past this roller from a trough in which the roller was located. In those cases in which a relatively wide trough was used, as was common, the liquid-applying roller could entrain a film of air into the liquid in the trough and because of the stirring action and the presence of this air, could cause the liquid to foam to the detriment of uniform layer application. When the trough was used merely to apply the layer from the bottom of the trough to the surface, for example, so that entrainment of an air film into the liquid in the trough was not as significant a problem, difficulties were encountered in effectively adjusting the gap through which the liquid was transferred to the surface and again uniformity of the film was adversely affected or the film had to be much thicker than was desired.

OBJECTS OF THE INVENTION

It is the principal object of the present invention, therefore, to provide a method of and an apparatus for applying a thin layer of a liquid to a moving surface whereby the disadvantages enumerated above are obviated.

Another object of this invention is to provide an apparatus for the uniform transfer in predetermined quantities of a liquid layer to a surface which enables the quantity of liquid to be metered with precision, which always feeds fresh liquid to the surface, and which excludes air from contact with the supply of liquid about to be transferred to thereby avoid the foaming action previously described.

Yet another object of this invention is to provide a liquid transfer system utilizing a liquid transfer drum adapted to receive a liquid layer and to apply this liquid layer to a substrate, e.g. a flexible web, whereby the uniform application of the liquid in the form of a layer to the drum is improved and the disadvantages of prior art systems are obviated.

SUMMARY OF THE INVENTION

These objects and other which will become apparent hereinafter are attained, in accordance with the present invention, in a liquid-transfer system in which a liquid is transferred to a surface from a trough containing the liquid, utilizing an applying roller which, in the direction of its rotation downstream of the location at which it contacts the surface, is connected sealingly to one side wall of the trough, picks up liquid and carries it in direction from an opposite side wall to the surface in the osculating region. Means is provided between this roller and this opposite side wall of the trough to form a seal preventing access of air to the contents of the trough. The roller has a textured liquid-applying surface which can be grooved, pitted, knurled, structured with a reticulate pattern or the like, textured in some other manner or simply porous.

According to a feature of the invention, the seal between the applying roller and this other wall of the trough may include a further roller which, in turn, sealingly engages this other wall of the trough and osculates the first mentioned roller by being similarly provided with a textured surface.

Alternatively, the other wall may be sealed with respect to the surface to which the liquid is applied by a sealing blade defining with the applying roller the narrow gap through which the liquid passes without exposure to the atmosphere onto the aforementioned surface.

In accordance with the principles of the invention, the latter seal can also be a stripping blade which includes an acute angle with the aforementioned opposite lateral wall of the trough and has its free edge disposed thereabove.

According to another feature of the invention, the contact between the applying roller and the first mentioned wall of the trough is effected via a yieldable sealing member, e.g. a body which can yieldably bear against this roller and which in turn is mounted on the first wall of the trough. This body can be a brush or the like.

The trough can be connected to one or more supply vessels for the liquid via one or more ducts and advantageously within the trough, directly below the applying roller, a baffle is provided to distribute the liquid. This baffle may define a narrow gap between a distribution passage along the bottom of the trough and the space in the region of the applying roller which can form the gap converging toward the outlet slot. It has been found to be advantageous in this connection, to position the applying roller such that its greatest horizontal dimension is disposed within the trough. Where required, the communication between the supply vessel and the trough can be effected such that the duct or ducts open into the gap between the applying roller and the opposite wall of the trough and best results are obtained when mechanical or magnetic means is provided to press the supply roller against the surface which is to be provided with the liquid layer.

The stripper blade can be slidable or pivotally adjustable relative to the opposite lateral wall of the trough with which it is coupled, and where a seal is provided between a side wall and a roller, this seal can bear against the roller at the point of greatest horizontal diameter.

The applying roller can be floatingly disposed in the trough and can be pressed by the roller to which the liquid is to be transferred and the liquid pressure against a side wall of the trough.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
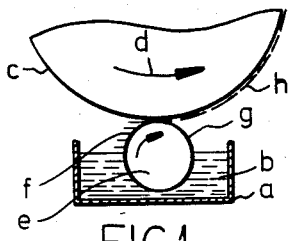
FIG.1 PRIOR ART
FIG. 1 is a diagram representing a partial vertical section through a liquid-applying device illustrating a prior art arrangement.
Figure 2:
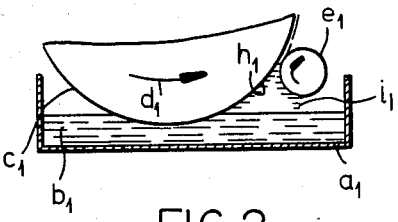
FIG.2 PRIOR ART
FIGS. 2 and 3 are diagrams similar to FIG. 1 also illustrating prior art systems.
Figure 3:
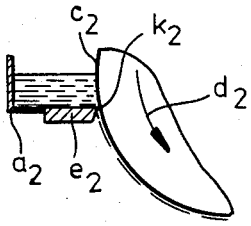

For a better understanding of the invention, reference may be had first to FIGS. 1 through 3 which shown prior art systems in the transfer of liquid layers.

In FIG. 1, for example, a fairly wide trough a contains a liquid b to be applied to a transfer drum c which is rotated in the direction of arrow d and is osculated by an applying drum e rotated in the liquid b. The liquid f is carried on the surface of the roller e onto the drum c from which it can be transferred to a web in the manner previously described. As the surface g of the roller rotates again into the liquid b, it entrains air into the latter and by reason of the stirring of the liquid in contact with this air causes foaming which may result in a nonuniform film h on the drum c.

A similar result obtains in the arrangement of FIG. 2 where the wide trough $a_1$ receives the drum $c_1$ directly as it is rotated in the direction of arrow $d_1$. Here the liquid layer $h_1$ is picked up by the drum from the bath $b_1$ of liquid directly and the uniformity of the layer is improved as the layer is entrained past the wiping roller $e_1$. Excess liquid is returned to the bath at $i_1$. Here the excess liquid cascades through the air into the bath in the trough and the latter is agitated by the transfer drum $c_1$ to promote foaming.

Foaming can be avoided by the use of a trough $a_2$ as shown in FIG. 3 where the applying blade $e_2$ defines a gap $k_2$ with the drum $c_2$ which is rotated in the direction of arrow $d_2$. However, it is difficult to adjust the width of this gap and hence control the uniformity of the coating.

Thus in the embodiments of FIGS. 1 and 2 foam formation constitutes a drawback while in the embodiment of FIG. 3, especially when the coating width is more than one meter, significant problems arise. In all three cases these problems are more significant at higher coating speeds.

Figure 4:
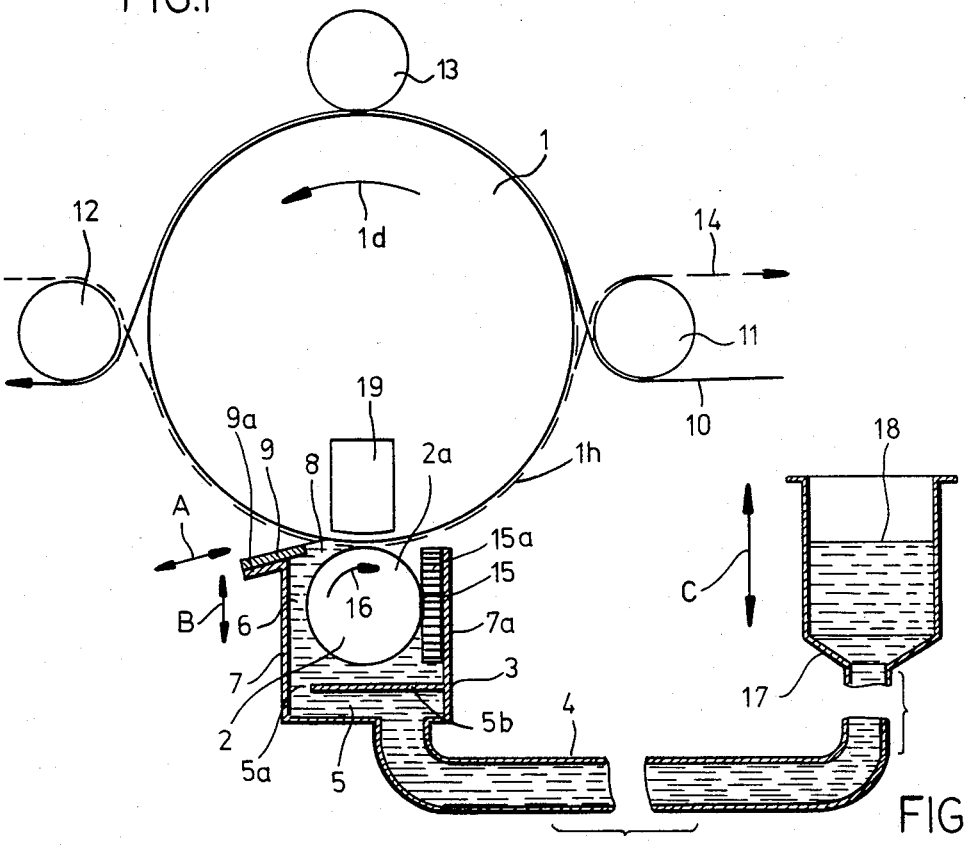
FIG. 4 is a diagrammatic vertical section illustrating an apparatus for applying a liquid to a transfer drum which can be utilized to transfer the liquid to a web or which can serve as a support for a web to which the liquid is directly applied.

With the system of the invention, not only is more precise metering of the liquid layer possible, but less liquid need be handled in total and the danger of foam formation can be eliminated. In FIG. 4, for example, representing the best mode, I have shown a transfer drum 1 which can be used for the indirect transfer of a liquid film 1*h* to a fabric web 10 or some other substrate as the transfer drum is rotated in the direction of the arrow 1*d*.

To guide the web 10 across the drum 1, guide rollers 11, 12 and 13 are provided around the periphery thereof. The roller 13 mechanically or magnetically presses the web 10 against the drum 1 so that the liquid film is transferred to the web.

To apply the liquid film 1*h* to the drum 1, a grooved applying roller 2 is provided, this roller contacting the drum 1 and being composed of a magnetic material so that it is attracted against the surface of the drum 1 by magnets disposed at 19. The journals for the drum and roller have not been shown but it should be noted that at least the journals for the roller 2 permit vertical movement of the roller under the operation of the magnet system 19 and that the rotation of the drum and roller can be synchronized by providing a common drive or synchronized motors or simply by entrainment. The means for driving the drum and the roller are of course conventional and need not be described.

The applying roller 2 is disposed in a narrowly dimensioned trough 3. This means that the trough 3 is substantially narrower than the troughs hitherto applied and represented, for example at a, $a_1$ and $a_2$, this trough having a lateral wall 7*a* limitedly spaced from an opposite lateral wall 7.

The trough 3 can be connected to one or more supply vessels 17 by one or more ducts 4 and each duct can open into the trough 3 in distribution passage 5 which communicates with the narrowly dimensioned throttle region 3, e.g. via a gap 5*a* between the baffle and a baffle 5*b* defining the top of the passage 5 and reaching toward this wall 7. A wedge-shaped outlet gap 8 is provided for the liquid.

According to the invention, a stripper blade 9, which can be slidably mounted on the wall 7 and is adjustable in the direction of the arrow A therein and can be adjusted in the direction of arrow B by shims 9*a*, wipes against the drum 1 to strip adherent air therefrom before this drum contacts the liquid. This blade also seals the liquid gap 8 from contact with the atmosphere and thus against the exterior while sealingly engaging the lateral wall 7.

The grooved or otherwise structured surface 2*a* of the roller 2 meters the liquid film 1*h* which is applied to the drum and thus controls the amount of liquid which is applied to the web 10.

A dot-dash line 14 represents another mode of operation of the device of FIG. 4, i.e. an operating mode in which the fabric 10 is passed over the roller 12, undershoots the drum 1 between the drum surface and the roller 2, and passes over the roller 11. In this mode of operation, the film 1*h* is applied directly to the fabric. This latter arrangement is effective only for nonbibulous material, i.e. only for material which does not suck up liquid in an uncontrolled manner.

During the transfer of liquid, the metering and applying roller 2 bears sealingly at 15 against the lateral wall 7*a* of the trough to provide a seal between the roller 2 and the lateral wall 7*a*, of the trough. A body 15*a* may be provided which is affixed to and forms part of this lateral wall and also bears yieldably and slidably against the roller 2. This body may be a brush, a body of felt or the like. This body serves to strip air from the roller 2 as the surface of this roller reenters the liquid in the trough so that the roller contacts the liquid in an air-free manner. The liquid is carried in the direction of arrow 16 onto the surface of the drum 1 and, since airfree liquid continuously reaches the gap 8, only fresh liquid is applied to the drum.

The level of the supply vessel 17 is represented at 18 and can be varied as represented by the arrow C so that the hydrostatic pressure can be adjusted to compensate for varying viscosities of the different liquids which are used, varying flow resistance and the like.

When work is at an end, the vessel 17 can be lowered and the liquid drained from the trough 3 through ducts 4 into the vessel by a siphon action. The vessel 17 can, in turn, be supplied by a pump from still a larger reservoir.

Figure 5:
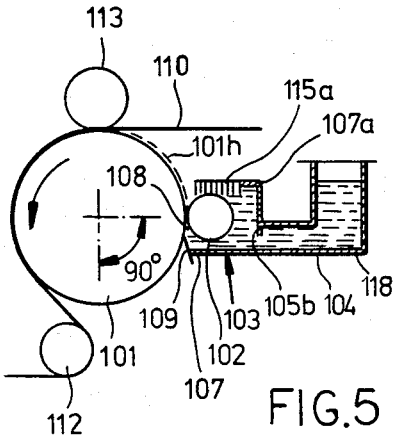
FIGS. 5, 6 and 7 are modifications of the system of FIG. 4 illustrating other embodiments of the invention.

In FIG. 5, the drum 101 cooperates with a pressing roller 113 and a guide roller 112 around which the web 110 can pass, thereby picking up the layer 101*h* of liquid from the drum over an angle of almost 180°. In this case, the trough 103 is swung through 90° from the position shown in FIG. 4 and opens laterally against the drum 101. The trough 103 thus receives the roller 102 between a wall 107 and a wall 107*a*, the latter being provided with a sealing pad 115*a* which bears directly against the roller 102 while the wiper blade 109 engages the drum 101 as previously described and defines the gap 108 through which the liquid is applied to the drum. The liquid is fed by a vessel 118 and a duct 104 past the baffle 105*b* in the manner previously described.

Figure 6:
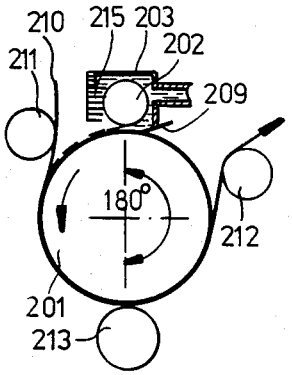

In FIG. 6, a web 210 can extend over more than 180° in contact with the drum and is pressed by a bottom roller 213 thereagainst while guide rollers 211 and 212 are provided for the web in the region in which the web subtends the drum 201. Here the trough 203 opens downwardly, i.e. is 180° offset from the position shown in FIG. 4. The roller 202 is engaged by the wall 215 and cooperates with the wiper blade 209 in the manner described.

Figure 7:
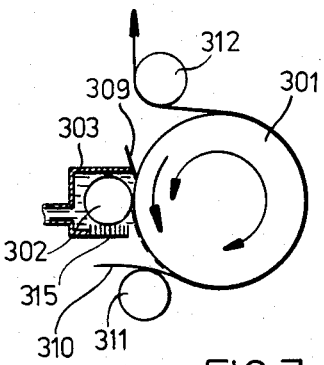

In FIG. 7, the trough 303 is offset by 270° from the position shown in FIG. 4 and is juxtaposed with the drum 301. Before the drum meets the web 310 directly below the drum, the web is guided by the rollers 311 and 312 which maintain the web under tension so that a pressing roller is not required. The liquid-applying roller 302 here rests upon the wall 315 and the stepping blade 309 is provided above the roller 302.

Figure 8:
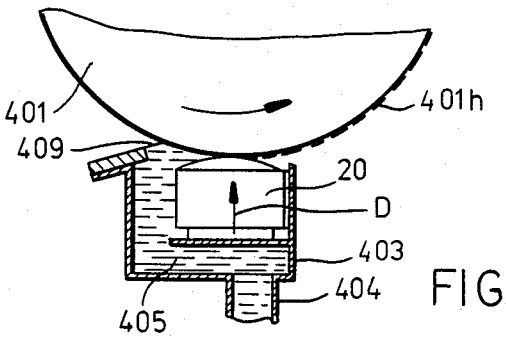
FIG. 8 shows an embodiment of the invention in which an applying element is used which is not a roller.

In the embodiment illustrated in FIG. 8, I have shown a less preferred embodiment of the invention wherein the liquid-applying or wiping roller 2, 102, 202 or 302 can be replaced by a floating bar 20 within the trough 403 which is, as in FIG. 4, supplied from below with the liquid via the duct 404 to the distributing passes 405. The upward force applied in the direction of arrow D can be effected by flotation, by a spring within the bar, by rotation or by magnetic operation as described in connection with element 19 in FIG. 4. The drum 401 thus receives the liquid layer 401*h* in the manner described from any air film stripped by the wiper 409.

Figure 9:
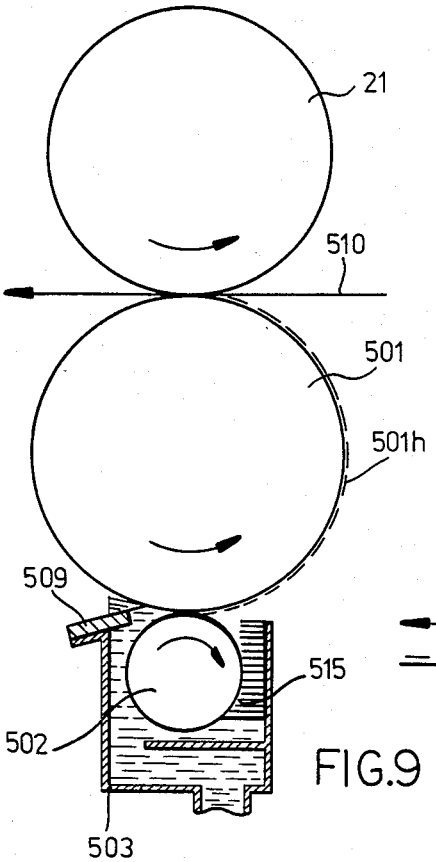
FIGS. 9 through 15 are diagrams in the form of vertical sections illustrating still other embodiments of the invention.

The application of the principles of the invention to direct transfer of liquid to a web in printing has been shown in FIG. 9. In this case, the transfer drum 501 cooperates with a pressing drum 21 which rotates in the opposite sense and between which the substrate 510 is passed. In this case, the drum 501 which receives the liquid layer 501*h* forms an intermediate drum between the roller 502 and the pressing drum 21. Since the trough 503, the roller 502, the pad 515 and the stripper blade 509 operate in the manner previously described for the corresponding elements of FIG. 4, separate description of this operation is unnecessary.

Note that this system permits flat fabric webs to be processed substantially in line contact between two members 21 and 501.

Note also that the systems thus far described are not only advantageous in preventing foam but are also highly useful for the application of liquids to surfaces when the liquids are extremely volatile, i.e. contain high proportions of volatile solvents since evaporation from the trough is practically excluded by the substantially complete closure thereof. FIG. 9 also shows that the wiper 509 can lie practically flat against the drum 501.

Figure 10:
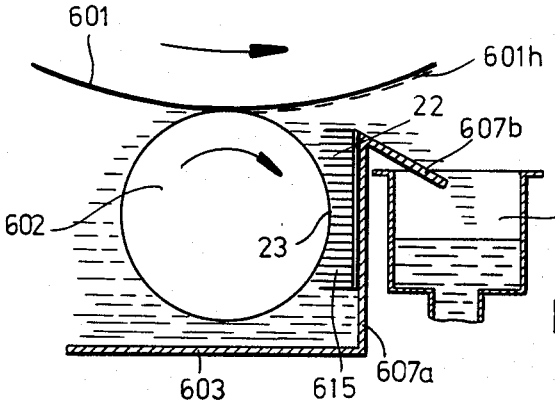

The embodiment shown in FIG. 10 differs from that of FIGS. 1 through 9 in that it provides, in addition to the trough 603, the brush wiper 615 and the liquid-applying drum 602, an apron 607*b* from the wall 607*a* which can conduct liquid vapor from the roller 602 into another vessel 24 and thereby prevent this liquid, which has been in contact with air, from being reentrained into the liquid within the trough 603.

This embodiment can be provided with a wiper blade (not shown) which is similar to that described at 9, 109 . . . 509 and the aforedescribed means for feeding the liquid to the trough 603.

In this case, the bristles of brush 615 hug the roller 602 in the region 23 and liquid which is collected by the upper bristles 22 is deflected onto the apron 607*b*.

The roller 602 applies the liquid to the drum 601 in a layer 601*h*. The bristles 22 not only remove excess liquid but also air bubbles and other contaminants from the surface of the roller 602 and thus constitute a cleaning means for this roller.

Figure 11:
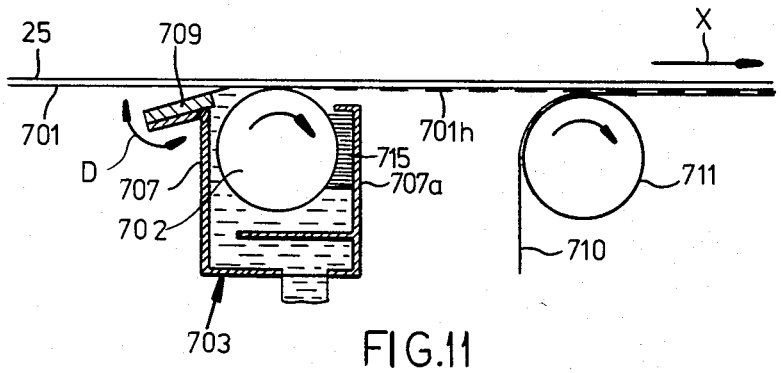

The embodiment of FIG. 11 is generally similar to those already described except that the roller 702 disposed between the walls 707 and 707*a* in the trough 703, applies the liquid in a layer 701*h* to the underside of a planar substrate 25 which is displaced in the direction of arrow X. This system need not have the height of the system of FIG. 9, for example, and may be useful where space is at a premium.

A web 710 may receive the liquid film from the transfer surface 701 of member 25. A guide roller 711 guides the web into contact with the film on the surface 701.

In this embodiment, a brush 715 sealingly connects the wall 707*a* with one side of the roller 702 whereas a wiper 709 engages the underside 701 of the band 25 to wipe air film therefrom. In this embodiment as in the others utilizing the wiper 9, 109 . . . , the wiper may be tiltable at different angles to the surface 1, 101 . . . 701, as represented by the arrow D for example in FIG. 11.

Figure 12:
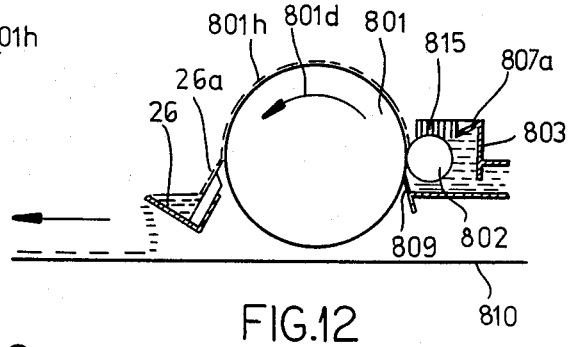

FIG. 12 illustrates yet another embodiment of the invention which can be considered a variant of that of FIG. 5. Here the trough 803 receives the roller 802 between the pad 815 and the wall 807*a* and the wiper 809 to apply a film 801*h* to the drum 801 as the latter is rotated in the direction of arrow 801*d*. In this case, the liquid film is lifted from the drum 801 by a blade 26*a* of a stripper arrangement from which the liquid is deposited into the web 810.

Figure 13:
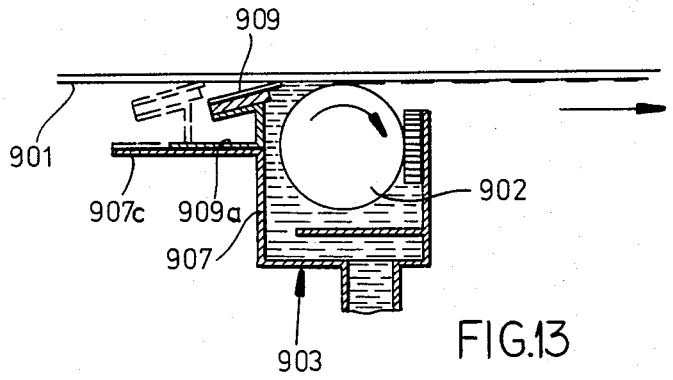

FIG. 13 shows a device which enables the wiper 909 to be shifted toward and away from the applying roller 902 of the trough 903. In this embodiment, the wall 907 is provided with an extension 907*c* on which a carrier 909*a* for the blade 909 can ride for movement between its broken line-position and solid-line position. The shifting of the wiper can also be effected within the trough or the wiper 909 can be swingably mounted on the extension or flange 907*c* for such adjustment.

This adjustability permits the duration of contact between the transfer surface 901 and the liquid in the trough to be varied. Otherwise this device operates in a manner similar to that of FIG. 11. Of course the shiftable carrier must sealingly engage the fixed portion of the wall. The surface 901 can also be provided on a drum if desired.

Figure 14:
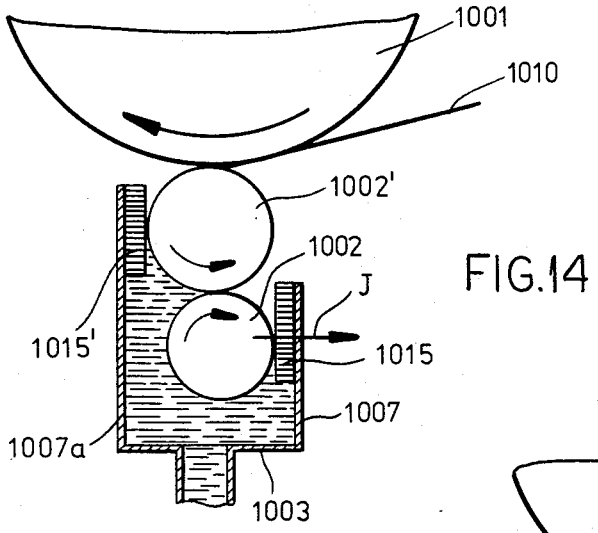

A stripper blade is eliminated in the embodiment of FIG. 14 in which the drum 1001 is juxtaposed with a transfer roller 1002', one surface of which is in contact with a pad, brush or like formation 1015' on a wall 1007*a* of a trough 1003.

The web 1010 is fed between the drum 1001 and the roller 1002'.

In this case, instead of controlling the contact between the liquid and the side of the roller 1002' approaching the drum 1001 with a wiper, I provide a further roller 1002 which also has a textured surface and which applies the liquid to the roller 1002'. The roller 1002 lies in contact with a pad or brush 1015 on the wall 1007 of the trough 1003. Otherwise, this system operates in the manner described with the advantage that entrainment of air into the liquid in the trough is minimized.

Figure 15:
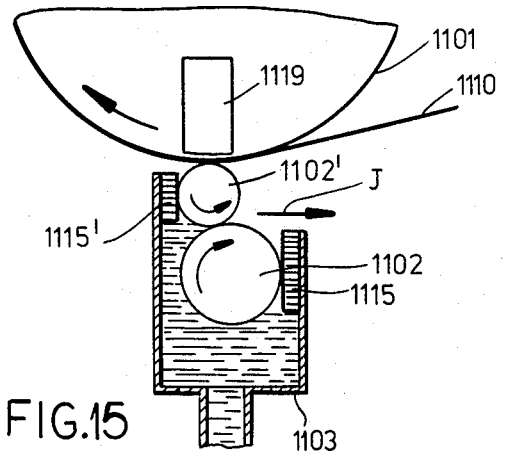

FIG. 15 shows an embodiment similar to that of FIG. 14 wherein, however, the trough 1103 has two rollers 1102' and 1102 of different sizes, both of which are drawn by the magnet system 1119 against the drum 1101 and the web 1110 and which are in contact with the pads or brushes 1115' or 1115, respectively.

The rollers 1102 and 1002 can be hollowed, if desired, to float and thereby apply upward force while they are urged against the respective pads by rotation and the resulting lateral force component J.

I claim:

1. An apparatus for applying a liquid layer of controlled thickness to a surface comprising:

a trough open in the direction of said surface and having a pair of opposite lateral walls relatively spaced apart from one another;

means for feeding said liquid to said trough;

a liquid-applying roller rotatable in said trough and extending the full width of said surface in said trough and in contact with one of said walls for transferring said layer of liquid from said roller to said surface, said roller having a liquid-transfer face of textured configuration;

means on the other of said walls limiting access of air to liquid in said trough; and a yieldable pad on said one of said walls directly contacting said roller for preventing entrainment of air by said roller into liquid in said trough, said means on said other wall including a wiper engaging said surface and extending toward the region of contact of said roller with said surface to define a gap with said roller through which liquid is permitted to contact said surface, said pad being a brush having bristles engaging said roller.

2. The apparatus defined in claim 1 wherein said roller contacts said pad at its largest horizontal dimension in said trough.

3. The apparatus defined in claim 1 wherein said wiper is mounted on said other wall to define an obtuse angle therewith with a free edge of the wiper being disposed above the trough, said roller being disposed wholly within said trough.

4. The apparatus defined in claim 1 wherein the means for feeding liquid to said trough includes a vessel communicating via a duct from below with said trough.

5. The apparatus defined in claim 4 wherein said member defines with said other wall a throttle passage for liquid approaching said surface, said duct opening into said throttle passage.

6. The apparatus defined in claim 5, further comprising a distributing passage between said duct and said throttle passage.

7. The apparatus defined in claim 1 wherein said surface is the surface of a transfer drum directly juxtaposed with said roller, further comprising means for applying a web of material to said drum.

8. An apparatus for applying a liquid layer of controlled thickness to a surface comprising:

a trough open in the direction of said surface and having a pair of opposite lateral walls relatively spaced apart from one another;

means for feeding said liquid to said trough;

a liquid-applying roller rotatable in said trough and extending the full width of said surface in said trough and in contact with one of said walls for transferring said layer of liquid from said roller to said surface, said roller having a liquid-transfer face of textured configuration;

means on the other of said walls limiting access of air to liquid in said trough; and a yieldable pad on said one of said walls directly contacting said roller for preventing entrainment of air by said roller into liquid in said trough, said means on said other wall including a wiper engaging said surface and extending toward the region of contact of said roller with said surface to define a gap with said roller through which liquid is permitted to contact said surface, said roller floating in said trough and being urged by movement of said surface into contact with said one of said walls.

9. An apparatus for applying a liquid layer of controlled thickness to a surface comprising:

a trough open in the direction of said surface and having a pair of opposite lateral walls relatively spaced apart from one another;

means for feeding said liquid to said trough;

a liquid-applying roller rotatable in said trough and extending the full width of said surface in said trough and in contact with one of said walls for transferring said layer of liquid from said roller to said surface, said roller having a liquid-transfer face of textured configuration;

means on the other of said walls limiting access of air to liquid in said trough;

a yieldable pad on said one of said walls directly contacting said roller for preventing entrainment of air by said roller into liquid in said trough, said means on said other wall including a wiper engaging said surface and extending toward the region of contact of said roller with said surface to define a gap with said roller through which liquid is permitted to contact said surface; and magnetic means urging said roller against said surface.

10. An apparatus for applying a liquid layer of controlled thickness to a surface, comprising:

a trough open in the direction of said surface and having a pair of opposite lateral walls relatively spaced apart from one another;

means for feeding said liquid to said trough;

a liquid-applying roller rotatable in said trough and extending the full width of said surface in said trough for transferring said layer of liquid from said roller to said surface said roller having a liquid-transfer phase of textured configuration;

a yieldable pad on one of said walls directly connecting said roller for preventing entrainment of air by said roller into liquid in said trough; and a further roller extending the full width of the first mentioned roller in said trough and in contact with said first mentioned roller;

a further yieldable pad on the other of said walls directly contacting said further roller for preventing entrainment of air by said further roller into liquid in said trough, said first mentioned roller having a smaller diameter than said further roller.

11. An apparatus for applying a liquid layer of controlled thickness to a surface, comprising:

a trough open in the direction of said surface and having a pair of opposite lateral walls relatively spaced apart from one another;

means for feeding said liquid to said trough;

a liquid-applying roller rotatable in said trough and extending the full width of said surface in said trough and in contact with one of said walls for transferring said layer of liquid from said roller to said surface, said roller having a liquid-transfer face of textured configuration; and a wiper carrying said surface and extending toward the region of contact of said roller with said surface to define a gap with said roller through which said liquid is permitted to contact said surface, said wiper limiting access of air to liquid in said trough.

* * * * *